US009157299B2

(12) United States Patent
Vick, Jr. et al.

(10) Patent No.: US 9,157,299 B2
(45) Date of Patent: Oct. 13, 2015

(54) INTEGRATED OPENING SUBSYSTEM FOR WELL CLOSURE SYSTEM

(75) Inventors: James Dan Vick, Jr., Dallas, TX (US); Jimmie Robert Williamson, Jr., Carrollton, TX (US); Bruce Edward Scott, McKinney, TX (US); Russell Irving Bayh, III, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 340 days.

(21) Appl. No.: 13/703,933

(22) PCT Filed: Dec. 15, 2011

(86) PCT No.: PCT/US2011/065204

§ 371 (c)(1),
(2), (4) Date: Dec. 13, 2012

(87) PCT Pub. No.: WO2013/089746

PCT Pub. Date: Jun. 20, 2013

(65) Prior Publication Data

US 2013/0175025 A1 Jul. 11, 2013

(51) Int. Cl.
*E21B 34/08* (2006.01)
*E21B 34/14* (2006.01)
(Continued)

(52) U.S. Cl.
CPC ..... *E21B 34/14* (2013.01); *E21B 34/08* (2013.01); *E21B 34/10* (2013.01); *E21B 34/16* (2013.01); *E21B 43/128* (2013.01)

(58) Field of Classification Search
CPC ..... E21B 2304/002; E21B 2034/005; E21B 34/08; E21B 34/102; E21B 34/101; E21B 43/121; E21B 43/128; E21B 34/14
See application file for complete search history.

(56) References Cited

U.S. PATENT DOCUMENTS 3,731,742 A * 5/1973 Sizer et al. ..... 166/375
4,191,248 A 3/1980 Huebsch et al.
(Continued)

FOREIGN PATENT DOCUMENTS

WO 2013089730 6/2013
WO 2013089753 6/2013

OTHER PUBLICATIONS

International Patent Application No. PCT/US2011/065109, "International Search Report and Written Opinion", mailed Aug. 3, 2012, 9 pages.
(Continued)

*Primary Examiner* — Cathleen Hutchins
(74) *Attorney, Agent, or Firm* — Kilpatrick Townsend & Stockton LLP

(57) ABSTRACT

Certain aspects and embodiments of the present invention are directed to a subsurface safety valve that can be disposed in a wellbore that is through a fluid-producing formation. The subsurface safety valve can include a closure mechanism, a sleeve, and a control line. The closure mechanism can be positioned in a passageway defined by a tubing string. The closure mechanism can be configured to prevent a flow of fluid to a portion of the passageway that is closer to a surface of the wellbore than the closure mechanism. The sleeve can be positioned in the passageway adjacent to the closure mechanism. The control line can communicate pressure to a piston from a pressure source within an inner diameter of the tubing string, causing the piston to apply a force to the sleeve. The sleeve can open the closure mechanism in response to the force being applied to the sleeve.

10 Claims, 6 Drawing Sheets

(51) Int. Cl.

| | |
|---|---|
| ***E21B 43/12*** | (2006.01) |
| ***E21B 34/16*** | (2006.01) |
| ***E21B 34/10*** | (2006.01) |

(56) References Cited

U.S. PATENT DOCUMENTS

| | | | | |
|---|---|---|---|---|
| 4,425,965 | A | 1/1984 | Bayh et al. | |
| 4,440,221 | A | 4/1984 | Taylor et al. | |
| 4,621,689 | A | 11/1986 | Brookbank, III | |
| 4,768,594 | A * | 9/1988 | Akkerman | 166/319 |
| 4,852,648 | A | 8/1989 | Akkerman et al. | |
| 4,880,060 | A * | 11/1989 | Schwendemann et al. | 166/336 |
| 5,070,944 | A | 12/1991 | Hopper | |
| 5,996,687 | A | 12/1999 | Pringle et al. | |
| 6,089,322 | A | 7/2000 | Kelley et al. | |
| 6,227,299 | B1 | 5/2001 | Dennistoun | |
| 6,283,217 | B1 | 9/2001 | Deaton | |
| 6,398,583 | B1 | 6/2002 | Zehren | |
| 6,957,703 | B2 | 10/2005 | Trott et al. | |
| 7,624,795 | B1 * | 12/2009 | Bangash et al. | 166/105 |
| 7,798,229 | B2 | 9/2010 | Vick, Jr. et al. | |
| 8,056,621 | B2 | 11/2011 | Ring et al. | |
| 2002/0053426 | A1 | 5/2002 | Kelley et al. | |
| 2003/0234104 | A1 | 12/2003 | Johnston et al. | |
| 2004/0188096 | A1 | 9/2004 | Traylor | |
| 2006/0118307 | A1 * | 6/2006 | Williamson et al. | 166/321 |
| 2007/0187107 | A1 | 8/2007 | Pringle | |
| 2007/0205000 | A1 | 9/2007 | Hosie et al. | |
| 2007/0295504 | A1 | 12/2007 | Patel | |
| 2008/0230231 | A1 | 9/2008 | Bolding et al. | |
| 2010/0108320 | A1 | 5/2010 | Larnach | |
| 2011/0155381 | A1 | 6/2011 | Reaux | |
| 2011/0155392 | A1 | 6/2011 | Frazier | |
| 2011/0247828 | A1 | 10/2011 | Patel et al. | |
| 2012/0199367 | A1 | 8/2012 | Bouldin et al. | |
| 2013/0175042 | A1 | 7/2013 | Scott et al. | |
| 2013/0206389 | A1 | 8/2013 | Vick, Jr. et al. | |

OTHER PUBLICATIONS

International Patent Application No. PCT/US2011/065204, "International Search Report and Written Opinion", mailed Sep. 12, 2012, 10 pages.

International Patent Application No. PCT/US2011/065253, "International Search Report and Written Opinion", mailed Sep. 12, 2012, 9 pages.

* cited by examiner

INTEGRATED OPENING SUBSYSTEM FOR WELL CLOSURE SYSTEM

CROSS-REFERENCE TO RELATED APPLICATIONS

This application is a U.S. national phase patent application under 35 U.S.C. 371 of International Patent Application No. PCT/US2011/065204 entitled "Integrated Opening Subsystem for Well Closure System," filed Dec. 15, 2011, and is related to International Patent Application No. PCT/US2011/065253 entitled "Subsurface Safety Valve Deployable Via Electric Submersible Pump," filed Dec. 15, 2011; International Patent Application No. PCT/US2011/065109 entitled "Dual Closure System for Well System," filed Dec. 15, 2011; U.S. patent application Ser. No. 13/703,953 entitled "Subsurface Safety Valve Deployable Via Electric Submersible Pump," filed Dec. 13, 2012; and U.S. patent application Ser. No. 13/703,963 entitled "Dual Closure System for Well System", filed Dec. 13, 2012; the contents of each of which are incorporated herein by reference in their entirety.

TECHNICAL FIELD OF THE INVENTION

The present invention relates generally to devices for controlling fluid flow in a bore in a subterranean formation and, more particularly (although not necessarily exclusively), to devices that are capable of preventing the production of fluid through a well traversing a subterranean formation.

BACKGROUND

Equipment for operating a well, such as an oil or gas well for extracting fluids that can include petroleum oil hydrocarbons from a subterranean formation, can include various devices for restricting or preventing the flow of fluids from a hydrocarbon-bearing subterranean formation in which the well is located. Pressure from a hydrocarbon-bearing subterranean formation can cause fluids from the formation to move toward the surface in the absence of a pumping system or other artificial lift system.

Closure mechanisms for restricting or preventing the production of fluids from a well, such as a safety valve, can be set to an open position, allowing the flow of production fluids, or a closed position, preventing the flow of production fluids. Current solutions for opening a safety valve can involve equipment having high power requirements or the insertion of additional components in the wellbore in addition to the safety valve. For example, one solution for opening the closure mechanism includes an electrically powered motor applying force to the closure mechanism, causing the closure mechanism to open. Another solution can include using hydraulic pressure to open the closure mechanism by deploying a separate control line from the surface to the closure mechanism in the wellbore. This solution increases the number of components being operated in the wellbore.

Apparatuses and systems are desirable that can reduce the power requirements and the number of components in the wellbore for opening a closure device regulating the flow of fluids in a well.

SUMMARY

Certain aspects and embodiments of the present invention are directed to a subsurface safety valve having an integrated opening subsystem that can be disposed in a wellbore that is through a fluid-producing formation. The subsurface safety valve can include a closure mechanism and an opening subsystem. The closure mechanism can be positioned in a passageway defined by a tubing string. The closure mechanism can be configured to prevent a flow of fluid to a portion of the passageway that is closer to a surface of the wellbore than the closure mechanism. The opening subsystem can include a sleeve and a control line. The sleeve can be positioned in the passageway adjacent to the closure mechanism. The control line can communicate pressure from a pressure source within an inner diameter of the tubing string to a piston from a pressure source in an inner diameter of the tubing string. The pressure communicated to the piston can cause the piston to apply a force to the sleeve. The force applied to the sleeve can cause the closure mechanism to open.

Another embodiment is directed to a well closure system disposed in a wellbore through a fluid-producing formation. The well closure system can include a pump and a subsurface safety valve. The subsurface safety valve can include a pressure-communicating device configured to communicate pressure from a discharge port of the pump to a piston, displacing the piston. Displacing the piston can cause the piston to apply a force to the sleeve, causing a closure mechanism to open. In some embodiments, the pump can be an electric submersible pump coupled to the subsurface safety valve. In other embodiments, the pump can be an auxiliary pump comprised in an electric submersible pump coupled to the subsurface safety valve.

These illustrative aspects and embodiments are mentioned not to limit or define the invention, but to provide examples to aid understanding of the inventive concepts disclosed in this application. Other aspects, advantages, and features of the present invention will become apparent after review of the entire application.

DETAILED DESCRIPTION

Figure 1:
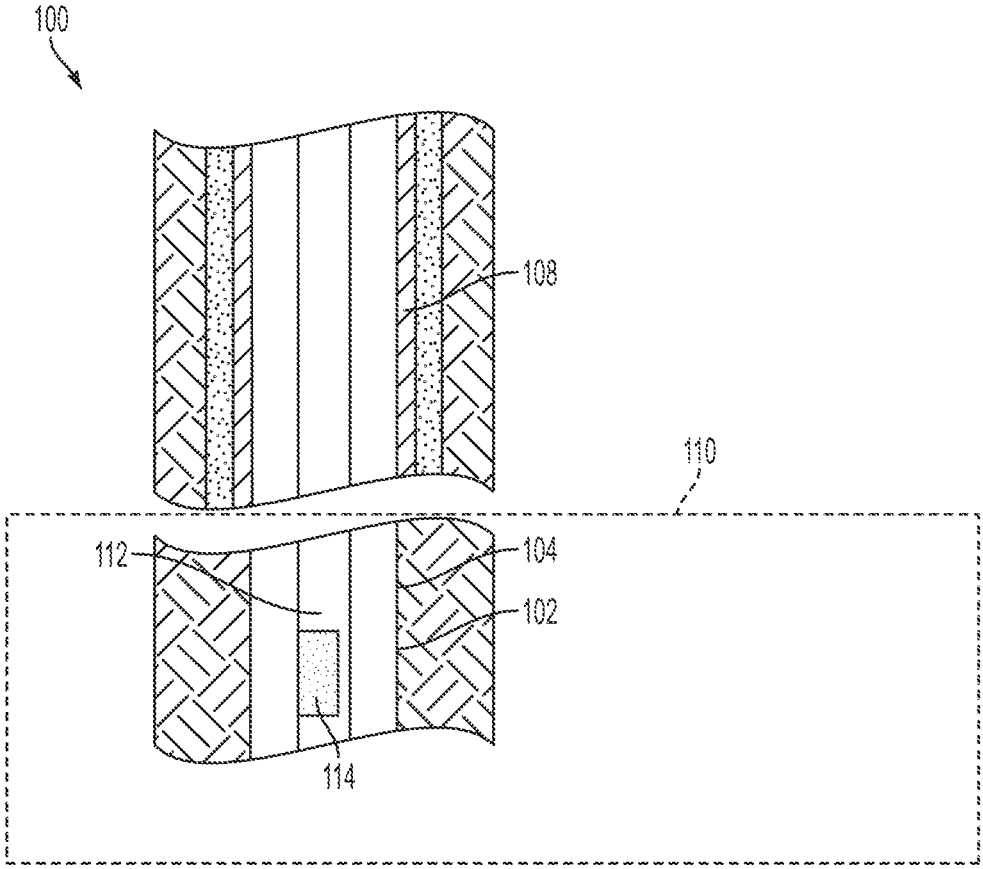
FIG. 1 is a schematic illustration of a well system in which a well closure system having a subsurface safety valve with an integrated opening subsystem can be disposed according to certain embodiments of the present invention.

Certain aspects and embodiments of the present invention are directed to a subsurface safety valve having an integrated opening subsystem that can be disposed in a wellbore that is through a fluid-producing formation. An integrated opening subsystem can be a system for opening the subsurface safety valve without inserting additional components, such as a hydraulic control line, from the surface into the wellbore. The integrated opening subsystem can include a control line included in the subsurface safety valve. The control line can communicate pressure from different sources within the well itself, thereby obviating the need to run a control line from the surface of the wellbore to the subsurface safety salve.

The subsurface safety valve can include a closure mechanism and an opening subsystem. The closure mechanism can be positioned in a passageway defined by a tubing string. The closure mechanism can be configured to prevent a flow of fluid to a portion of the passageway that is closer to a surface of the wellbore than the closure mechanism. The opening subsystem can include a sleeve and a control line. The sleeve can be a biasing device to displace the closure mechanism, thereby opening or at least maintaining open the subsurface safety valve. The sleeve can be a tubing section coupled to a compression spring. The sleeve can be positioned in the passageway adjacent to the closure mechanism. The control line can be a hydraulic line integrated into the subsurface safety valve. The control line can communicate pressure to a piston, displacing the piston and thereby causing the piston to apply a force to the sleeve. The control line can remain pressurized during operation of the subsurface safety valve. A leak or other failure causing a loss of pressure in the control line can cause the subsurface safety valve to close. The sleeve can open the closure mechanism in response to the force being applied to the sleeve. Opening the closure mechanism can allow a flow of fluid to a portion of the passageway that is closer to the surface of the wellbore than the closure mechanism.

The closure mechanism can be any mechanism for permitting fluid to flow or pressure to be communicated in one direction and preventing fluid from flowing or pressure from being communicated in an opposite direction. The closure mechanism can be in an open or a closed position. The open position can allow a flow of fluid to a portion of the passageway that is closer to the surface of the wellbore than the closure mechanism. The closed position can prevent a flow of fluid to a portion of the passageway that is closer to a surface of the wellbore than the closure mechanism.

Examples of closure mechanisms can include (but are not limited to) a flapper valve, a ball valve, or a poppet valve. A flapper valve can include a spring-loaded plate allowing fluids to be pumped in the downhole direction from the surface toward the fluid-producing formation. The flapper valve can close when the flow of fluid is directed toward the surface. A ball valve can include a spherical disc having a port through the middle such that fluids can flow through the ball valve when the port is aligned with both ends of the ball valve. The ball valve can be closed to block the flow of fluids by orienting spherical disc such that the port is perpendicular to the ends of the ball valve. A poppet valve can include a hole and a tapered plug portion, such as a disk shape on the end of a shaft. The shaft guides the plug portion by sliding through a valve guide. A pressure differential can seal the poppet valve.

In some embodiments, the sleeve can be a spring-loaded sleeve including a rigid tubing section and a compression spring. The spring-loaded sleeve can be cocked by utilizing a pressure differential across the closure mechanism. Cocking the spring-loaded sleeve can include compressing the spring of the sleeve such that subsequently extending the spring can cause the sleeve to apply a force sufficient to open the closure mechanism. The spring of the sleeve can be compressed by a first force applied by the piston to one point on the sleeve or spring and a second force applied to another point on the sleeve or spring and opposing the first force. The second force can be caused by a pressure differential across the closure mechanism. The second force can be reduced or eliminated by equalizing the pressure differential across the closure mechanism. The spring of the sleeve can extend in response to equalizing the pressure differential. Extending the spring can cause the sleeve to apply a force opening the closure mechanism. In additional or alternative embodiments, the force applied by the piston can displace the sleeve, causing the sleeve to apply a force opening the closure mechanism.

In some embodiments, the electric subsurface safety valve can include an equalizing subsystem configured to equalize pressure across the closure mechanism. Equalizing the pressure across the closure mechanism can decrease the force applied to set the closure mechanism to an open position. The equalizing subsystem can include, but is not limited to, an unloading pump configured to equalize pressure across the closure mechanism. An unloading pump can communicate fluid or pressure from a first portion of the passageway that is further from the surface of the wellbore than the closure mechanism to a second portion of the passageway that is closer to the surface of the wellbore than the closure mechanism.

In some embodiments, the subsurface safety valve can include a return mechanism. The return mechanism can be a biasing device that can cause the sleeve to be displaced such that the force applied to the closure mechanism is reduced or removed. The return mechanism displacing the sleeve can cause the closure mechanism to close. The return mechanism can include, for example, a spring coupled to the piston. Applying a force that displaces the piston can extend the spring coupled to the piston. The spring can have a tension such that in the absence of a force causing the spring to extend, contraction of the spring can apply a force causing the piston to retract.

In additional or alternative embodiments, a locking mechanism can prevent the return mechanism from retracting the sleeve. Triggering the locking mechanism can prevent the closure mechanism from closing. The locking mechanism can be triggered in response to the control line communicating pressure to the piston. In some embodiments, the locking mechanism can be triggered by the extension of the sleeve opening the closure mechanism. In other embodiments, the locking mechanism can be manually activated.

In some embodiments, the locking mechanism can be an electrical trigger receiving power from an electric submersible pump disposed in the wellbore. The locking mechanism can be configured to apply force opposing the operation of the return mechanism while power is provided to the electrical trigger. The locking mechanism can cease applying force opposing the operation of the return mechanism in response to ceasing the provision of power to the locking mechanism.

In other embodiments, the locking mechanism can receive power from a battery included in the subsurface safety valve. The battery-powered locking mechanism can cease applying force opposing the operation of the return mechanism in response to a sensor detecting the electric submersible pump ceasing operating. The sensor can be an electrical sensor detecting a current or voltage from the operation of the electric submersible pump. The sensor can also be a sensor detecting the motion or sound resulting from the electric submersible pump extracting production fluids from the well.

In additional or alternative embodiments, the control line can communicate pressure from a portion of the passageway that is further from the surface of the wellbore than the closure mechanism. The pressure can include hydraulic pressure resulting from the production of fluids from the subterranean formation. The control line can communicate pressure to the piston, causing the piston to displace.

In additional or alternative embodiments, the control line can communicate pressure from a discharge port of an electric submersible pump disposed in the wellbore. In other embodiments, the control line can communicate pressure from a discharge port of an auxiliary pump disposed in the wellbore. The control line can prevent the return mechanism from displacing the sleeve by communicating additional pressure from the discharge port to the return mechanism. For example, when a return mechanism includes a spring, communicating pressure from the discharge port to the piston can apply a force preventing the spring from contracting during operation of the electric submersible pump. Ceasing operation of the electric submersible pump can remove the force opposing the contraction of the spring, allowing the return mechanism to retract the piston and thereby closing the closure mechanism.

In additional or alternative embodiments, the control line can be replaced by communicating pressure via one or more seals configured to isolate fluid from the discharge port in an annular space between the pump and the tubing string.

In some embodiments, the subsurface safety valve can be deployed with the tubing string during the installation of the well system. In other embodiments, the subsurface safety valve can be a retrievable system that can be deployed and/or retrieved via a cable by a retrieval unit. A retrieval unit can be a mechanism including a cable for lowering tools into a wellbore. An example of a retrieval unit is a wireline unit. In other embodiments, the subsurface safety valve can be coupled to an electric submersible pump. The subsurface safety valve coupled with the electric submersible pump can be deployed and/or retrieved via a cable by a retrieval unit.

In additional or alternative embodiments, a two-stage closing process can prevent accidental closure of the subsurface safety valve during the operation of an electric submersible pump. The first stage can include transmitting a signal to the subsurface safety valve to close the subsurface safety valve partially. The second stage can include completely closing the subsurface safety valve when the electric submersible pump ceases operation.

In additional or alternative embodiments, a trigger mechanism can terminate operation of the electric submersible pump upon closure of the subsurface safety valve. Terminating operation of the electric submersible pump can prevent damage to the electric submersible pump caused by the electric submersible pump operating in the absence of fluid within a passageway defined by the tubing string.

In some embodiment, a trigger mechanism can include, for example, a float switch configured to be in an "on" position by fluid flowing through a passageway defined by the tubing string, allowing operation of the electric submersible pump. Closing the subsurface safety valve can cause fluid to cease flowing through the passageway defined by the tubing string, setting the float switch to an "off" position and terminating operation of the electric submersible pump.

In additional or alternative embodiments, the electric subsurface safety valve can include a sensor that prevents activation of a trigger mechanism closing the closure mechanism. The sensor can be an electrical sensor detecting a current or voltage from the operation of the electric submersible pump. The sensor can also be a sensor detecting the motion or sound resulting from the electric submersible pump extracting production fluids from the well.

In additional or alternative embodiments, the well closure system can include an override subsystem configured to open the subsurface safety valve in response to a power failure causing the subsurface safety valve to close. The override subsystem can maintain the electric subsurface safety valve in an open position during a power failure. In some embodiments, the override can include a motor powered by the battery power subsystem. The motor can apply force opening the electric subsurface safety valve in response to the communication subsystem receiving a signal directing the override to open the electric subsurface safety valve. In other embodiments, the override subsystem can include a motor operated using a current from the electric submersible pump. For example, a current operating in a positive direction can operate the electric submersible pump and the current operating in a negative direction can operate the electric subsurface safety valve.

In additional or alternative embodiments, the well closure system can include one or more sensors to monitor performance of the electric submersible pump and/or the subsurface safety valve.

These illustrative examples are given to introduce the reader to the general subject matter discussed here and are not intended to limit the scope of the disclosed concepts. The following sections describe various additional embodiments and examples with reference to the drawings in which like numerals indicate like elements, and directional descriptions are used to describe the illustrative embodiments but, like the illustrative embodiments, should not be used to limit the present invention.

FIG. 1 depicts a well system 100 in which a well closure system 114 having a subsurface safety valve with an integrated opening subsystem can be disposed according to certain embodiments of the present invention. The well system 100 includes a wellbore 102 extending through various earth strata. The wellbore 102 has a substantially vertical section 104. The substantially vertical section 104 may include a casing string 108 cemented at an upper portion of the substantially vertical section 104. The substantially vertical section 104 extends through a hydrocarbon-bearing subterranean formation 110.

A tubing string 112 extends from the surface within wellbore 102. The tubing string 112 can define a passageway providing a conduit for production of formation fluids to the surface.

The well closure system 114 is positioned within a passageway defined by the tubing string 112. The well closure system 114 is depicted as functional block in FIG. 1. Pressure from the subterranean formation 110 can cause fluids to flow from the subterranean formation 110 to the surface. The well closure system 114 can include equipment capable of restricting or preventing the production of formation fluids.

Although FIG. 1 depicts the well closure system 114 positioned in the substantially vertical section 104, a well closure system 114 can be located, additionally or alternatively, in a deviated section, such as a substantially horizontal section. In some embodiments, well closure systems 114 can be disposed in wellbores having both a substantially vertical section and a substantially horizontal section. Well closure systems 114 can be disposed in open hole environments, such as is depicted in FIG. 1, or in cased wells.

Figure 2:
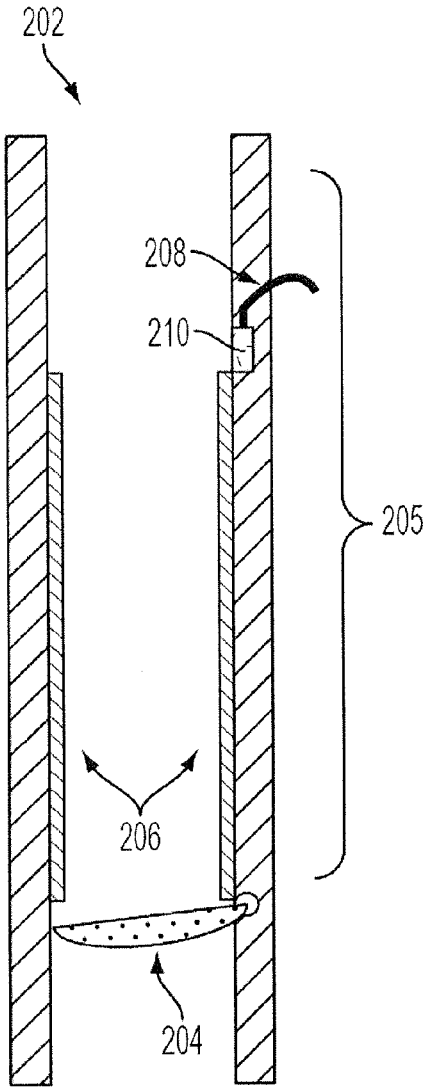
FIG. 2 is a cross-sectional side view of a subsurface safety valve having an integrated opening subsystem according to one embodiment of the present invention.

A well closure system 114 can include a subsurface safety valve. FIG. 2 depicts a cross-sectional side view of a subsurface safety valve 202 having an integrated opening subsystem 205 according to one embodiment. The subsurface safety valve 202 can include a closure mechanism 204 and the opening subsystem 205. The opening subsystem 205 can include a sleeve 206, control line 208, and a piston 210.

The closure mechanism 204 can be any mechanism for restricting or preventing the flow of fluid from the fluid-producing formation fluid to the surface of the wellbore, such as a valve. The closure mechanism 204 is depicted in FIG. 2 as a flapper valve. Other examples of a closure mechanism 204 can include (but are not limited to) a poppet valve or a ball valve.

The sleeve 206 can be adjacent to and in contact with the closure mechanism 204. In some embodiments, the sleeve 206 can be a spring-loaded sleeve including a rigid tubing section and a compression spring.

Figure 3:
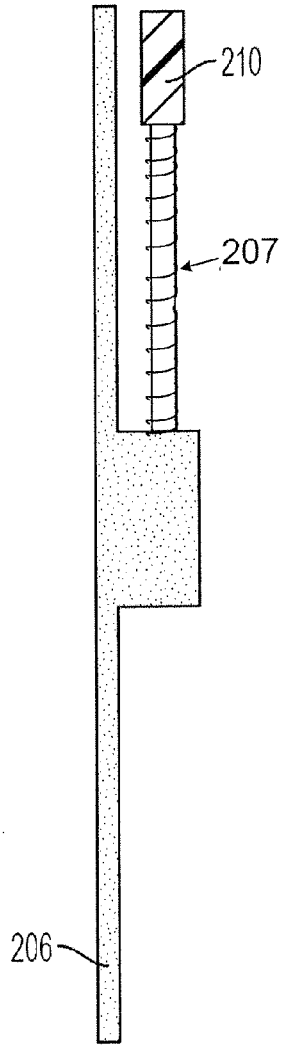
FIG. 3 is a cross-sectional side view of a piston coupled to the sleeve of a subsurface safety valve according to one embodiment of the present invention.

FIG. 3 depicts a cross-sectional side view of the piston 210 coupled to the sleeve 206 according to one embodiment. In some embodiments, the piston 210 can apply force to a spring 207 or other spring-loaded device coupled to the sleeve 206 at a midpoint of the sleeve, as depicted in FIG. 3. In other embodiments, the piston 210 can apply force to the sleeve 206 without using a spring 207 or other spring-loaded device. The control line 208 can communicate pressure to the piston 210. The pressure can apply a force to the piston 210. The force applied to the piston 210 can displace the piston 210, causing the piston to apply force to the sleeve 206. The force applied to the sleeve 206 can cause the sleeve 206 to apply force to the subsurface safety valve 202.

The sleeve 206 can be cocked by utilizing a pressure differential across the closure mechanism 204. Cocking the sleeve 206 can include compressing the spring 207 of the sleeve 206. The spring 207 of the sleeve 206 can be compressed by a force applied by the piston 210 to one point on the spring 207 or the sleeve 206 and an opposing force applied to another point on the sleeve 206 caused by the pressure differential across the closure mechanism 204. The opposing forces can cause the spring 207 to compress.

The sleeve 206 can extend in response to equalizing the pressure differential across the closure mechanism 204. Equalizing the pressure differential across the closure mechanism 204 can remove a force from the compressed spring of the sleeve 206. The tension of the spring of the sleeve 206 can cause the sleeve 206 to extend in the absence of one of the forces compressing the spring. The extension of the sleeve 206 can apply a force against the closure mechanism 204, causing the closure mechanism 204 to open.

The pressure differential can be equalized by, for example, an unloading pump or other pressure equalization system or device configured to equalize pressure across the closure mechanism 204. An unloading pump can communicate fluid or pressure from a first portion of the passageway that is further from the surface of the wellbore 102 than the closure mechanism 204 to a second portion of the passageway that is closer to the surface of the wellbore 102 than the closure mechanism 204. Communicating fluid or pressure from the first portion of the passageway to the second of the passageway can equalize a pressure differential across the closure mechanism 204. The unloading pump can be operated using the pressure differential across the closure mechanism 204. Equalizing the pressure differential can remove the second force opposing the force applied by the sleeve 206. The spring 207 of the sleeve 206 can extend in the absence of the opposing force. Extending the spring 207 of the sleeve 206 can cause the subsurface safety valve 202 to open.

In some embodiments, the subsurface safety valve 202 can be deployed with the tubing string 112 during the installation of the well system 100. In other embodiments, the subsurface safety valve 202 can be a retrievable system that can be deployed and/or retrieved via a cable by a retrieval unit. In other embodiments, the subsurface safety valve 202 can be coupled to an electric submersible pump. The subsurface safety valve 202 coupled to the electric submersible pump can be deployed and/or retrieved via a cable by a retrieval unit.

Figure 4:
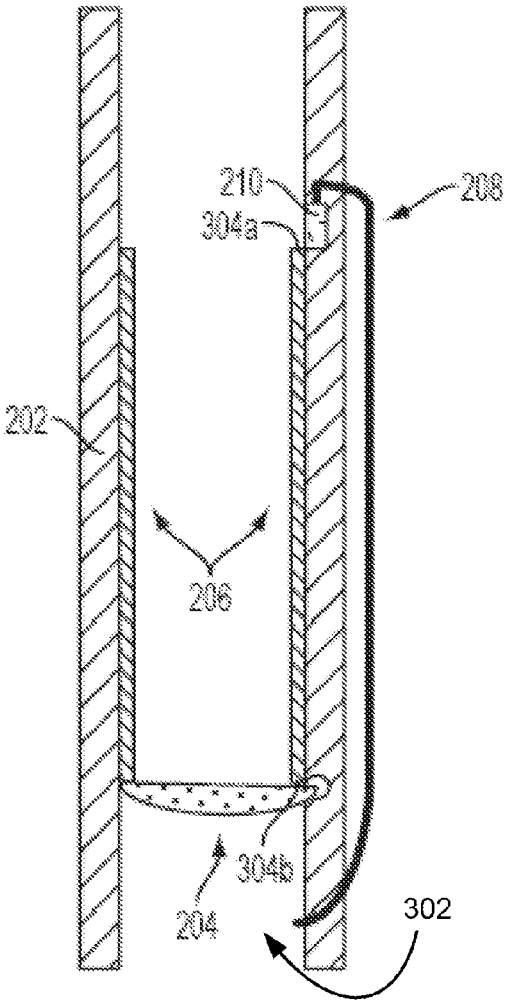
FIG. 4 is a cross-sectional side view of a subsurface safety valve having an integrated opening subsystem of an opening subsystem in the absence of pressure communicated to a piston according to one embodiment of the present invention.
Figure 5:
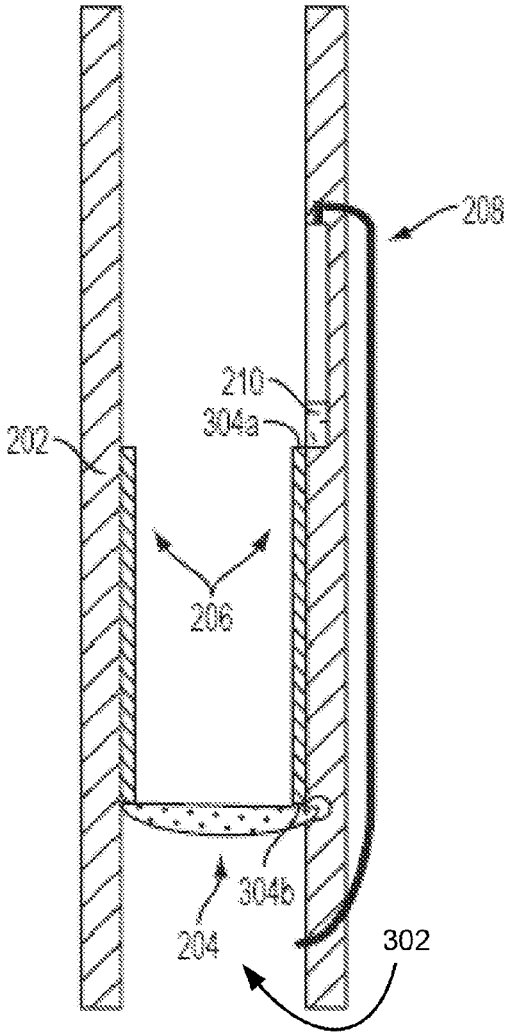
FIG. 5 is a cross-sectional side view of a subsurface safety valve having an integrated opening subsystem communicating pressure displacing a piston according to one embodiment of the present invention.
Figure 6:
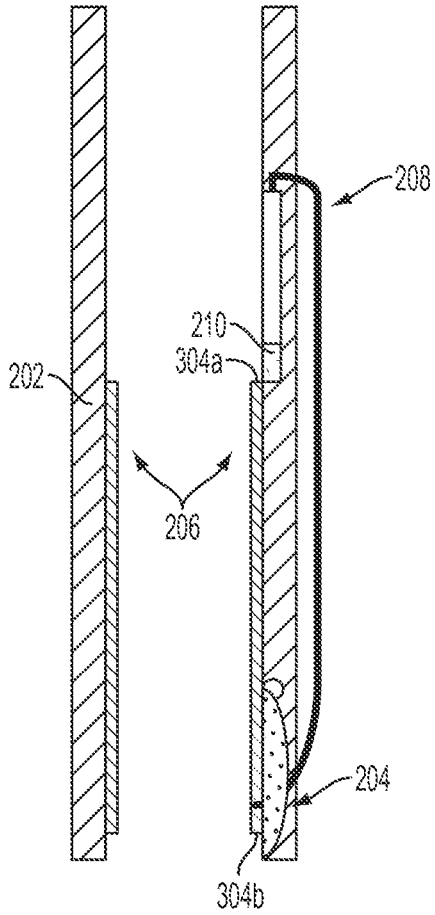
FIG. 6 is a cross-sectional side view of a subsurface safety valve having an integrated opening subsystem opening a closure mechanism according to one embodiment of the present invention.

FIGS. 4-6 depict cross-sectional side views illustrating the operation of the opening subsystem 205 according to one embodiment. The control line 208 depicted in FIGS. 4-6 can communicate pressure from a portion 302 of the passageway that is further from the surface of the wellbore than the closure mechanism 204. The pressure can include hydraulic pressure resulting from the production of fluids from the subterranean formation.

FIG. 4 depicts the opening subsystem 205 in the absence of pressure being communicated to the piston 210. The spring of the sleeve 206 can be extended in the absence of a pressure displacing the piston 210.

FIG. 5 depicts the opening subsystem 205 communicating pressure causing the piston 210 to displace. Displacing the piston 210 can cause force to be applied against a point 304*a* of the sleeve 206. The pressure differential can cause the closure mechanism 204 to apply an opposing force to a point 304*b* of the sleeve 206. The forces applied to the points 304*a*, 304*b* can cause the sleeve 206 to compress.

Although FIG. 5 depicts the points 304*a*, 304*b* at the ends of the sleeve 206, the points 304*a*, 304*b* can be located anywhere on the sleeve 206. For example, as depicted in FIG. 3, the piston 210 can be coupled to a point in the middle of the sleeve 206 such that displacing the piston 210 causes force to be applied at a point at the midpoint of the sleeve 206.

FIG. 6 depicts the opening subsystem 205 after equalizing the pressure differential across the closure mechanism 204. Equalizing the pressure differential across the closure mechanism 204 can remove the force applied to point 304*b* of the sleeve 206. Removing the force applied to point 304*b* of the sleeve 206 can cause the sleeve 206 to extend. Extension of the sleeve 206 can apply force against closure mechanism 204, setting the closure mechanism 204 to an open position.

The subsurface safety valve can include a return mechanism. The return mechanism can cause the sleeve 206 to retract. Retracting the sleeve can cause the closure mechanism 204 to close. The return mechanism can include, for example, a spring coupled to the piston 210. Applying a force displacing the piston 210 can cause the spring to extend. The spring can have a tension that, in the absence of a force causing the spring to extend, can cause the spring to contract. The contraction of the spring can retract the piston.

In additional or alternative embodiments, a locking mechanism can prevent the return mechanism from retracting the sleeve 206. An example of a locking mechanism is an opening prong assembly as described by U.S. Patent Application Publication No. 2011/0240299 to Vick, Jr., et al., entitled "Subterranean Well Valve Activated with Differential Pressure," incorporated by reference herein. Triggering the locking mechanism can prevent the closure mechanism 204 from closing. The locking mechanism can be triggered in response to the control line 208 communicating pressure to the piston 210. For example, the locking mechanism can be triggered by the extension of the sleeve 206 opening the closure mechanism.

In some embodiments, the locking mechanism can be an electrical trigger receiving power from an electric submersible pump disposed in the wellbore and coupled to the subsurface safety valve 202. The locking mechanism can be configured to operate while power is provided to the trigger mechanism. The locking mechanism can cease operating when the provision of power to the locking mechanism ceases.

In other embodiments, the locking mechanism can receive power from a battery included in the subsurface safety valve 202. The battery-powered locking mechanism can cease applying force opposing the operation of the return mechanism in response to a sensor detecting the electric submersible pump ceasing operating. The sensor can be an electrical sensor detecting a current or voltage from the operation of the electric submersible pump. The sensor can also be a sensor detecting the motion or sound resulting from the electric submersible pump extracting production fluids from the well.

Figure 7:
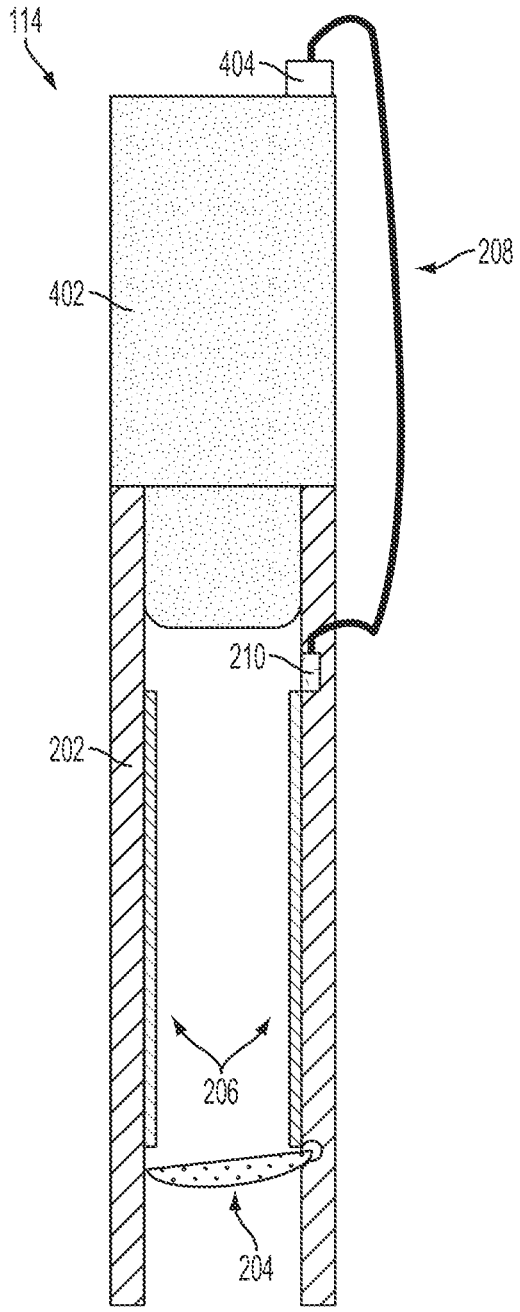
FIG. 7 is a cross-sectional side view of well closure system having a subsurface safety valve communicating pressure from a discharge port of an electric submersible pump according to one embodiment.

FIG. 7 depicts a cross-sectional side view of a well closure system 114 having a subsurface safety valve 202 communicating pressure from a discharge port 404 of an electric submersible pump 402 according to one embodiment. The well closure system 114 can include the subsurface safety valve 202 and the electric submersible pump 402.

The electric submersible pump 402 can be an electrically powered downhole pumping system or other artificial lift system for extracting formation fluids from the subterranean formation 110. The electric submersible pump 402 can include several staged centrifugal pump sections customized to the production characteristics and wellbore characteristics of a well. In some embodiments, the electric submersible pump 402 can include two or more independent electric submersible pumps coupled together for redundancy.

The opening subsystem 205 depicted in FIG. 7 can open the closure mechanism 204 in a manner similar to that depicted in FIGS. 4-6. The source of the pressure communicated by the control line 208 is the discharge fluid expelled from discharge port 404 rather than the formation fluid from the portion 302 of the passageway, as depicted in depicted in FIGS. 4-6.

The opening subsystem 205 depicted in FIG. 7 can maintain the closure mechanism 204 in an open position via hydraulic pressure. The control line 208 can communicate additional pressure from the discharge port during the operation of the electric submersible pump 402. The additional pressure can apply force against the piston 210 during the operation of the electric submersible pump 402, preventing the return mechanism from retracting the sleeve 206. Ceasing operation of the electric submersible pump 402 can cease the application of force against the piston 210, allowing the return mechanism to retract the piston 210 and closing the closure mechanism 204.

Although FIG. 7 depicts the well closure system 114 having a dedicated control line 208 from the discharge port 404, other embodiments can include the fluid from the discharge port 404 being transported via an annulus formed between the cable deployed components and the wall of the tubing string 112. An opening subsystem 205 transporting fluid from the discharge port 404 via an annulus can include appropriate annular seals between components for pressure isolation.

Figure 8:
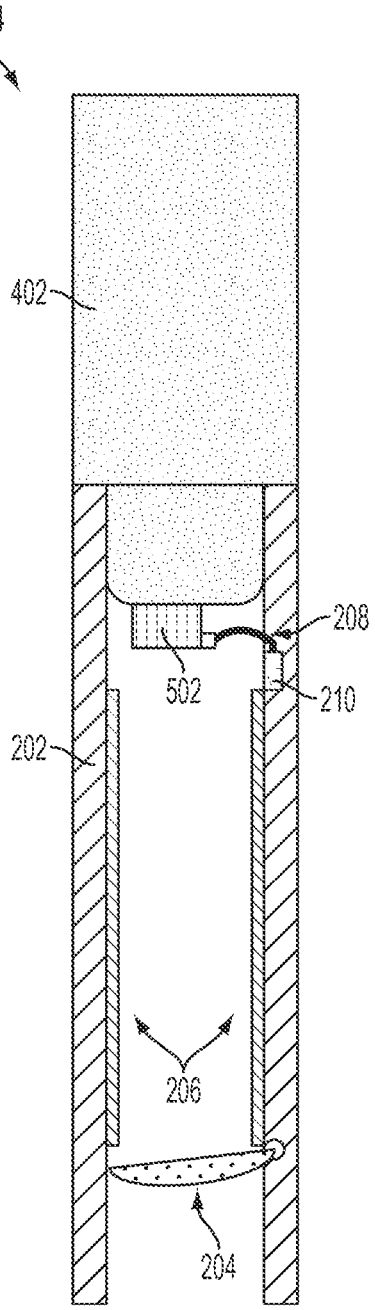
FIG. 8 is a cross-sectional side view of well closure system having a subsurface safety valve communicating pressure from a discharge port of an auxiliary pump of an electric submersible pump according to one embodiment.

FIG. 8 depicts a cross-sectional side view of a well closure system 114 having a subsurface safety valve 202 communicating pressure from a discharge port of an auxiliary pump 502 disposed in an electric submersible pump according to one embodiment.

The opening subsystem 205 depicted in FIG. 8 communicates pressure from an auxiliary pump rather than the electric submersible pump itself, as in the opening subsystem 205 depicted in FIG. 7. The opening subsystem 205 depicted in FIG. 8 can otherwise operate identically to the opening subsystem 205 depicted in FIG. 7.

The auxiliary pump 502 can be disposed or integrated in the electric submersible pump 402. The auxiliary pump 502 can be powered from the electric submersible pump 402 through either a direct drive mechanism, a gear mechanism, or a clutch mechanism.

The auxiliary pump 502 can include a fluid control mechanism allowing backflow and equalization when the auxiliary pump is not operating. The fluid control mechanism can be an open system or a closed system. An open system can utilize well fluids as a source of hydraulic pressure. A closed system can utilize a separate, dedicated "clean" fluid source as a source of hydraulic pressure.

The auxiliary pump 502 can be configured to begin operating before the electric submersible pump 402 begins operating. The auxiliary pump 502 beginning operation can cause the subsurface safety valve 202 to open prior to the electric submersible pump 402 beginning operation. Opening the subsurface safety valve 202 prior to operating the electric submersible pump 402 can prevent damage to the electric submersible pump 402 caused by the electric submersible pump 402 operating in the absence of fluid in the passageway defined by the tubing string 112. For example, the auxiliary pump 502 can be configured to begin operating at a voltage threshold that is lower than a voltage threshold at which the electric submersible pump 402 can begin operating.

The foregoing description of the embodiments, including illustrated embodiments, of the invention has been presented only for the purpose of illustration and description and is not intended to be exhaustive or to limit the invention to the precise forms disclosed. Numerous modifications, adaptations, and uses thereof will be apparent to those skilled in the art without departing from the scope of this invention.

The invention claimed is:

1. A well closure system having a subsurface safety valve configured for being disposed in a wellbore through a fluid-producing formation, the subsurface safety valve comprising:

a closure mechanism configured to be positioned in a passageway defined by a tubing string, wherein the closure mechanism is configured to prevent a flow of fluid to a portion of the passageway that is closer to a surface of the wellbore than the closure mechanism; and an opening subsystem comprising:

a sleeve adjacent to the closure mechanism, the sleeve configured to be positioned in the passageway defined by the tubing string;

a spring coupled to the sleeve, the spring configured to contract in response to a pressure differential across the closure mechanism and to extend in response to equalizing the pressure differential; and a control line configured to communicate pressure from a pressure source within an inner diameter of the tubing string to a piston causing the piston to apply a force to the sleeve;

wherein the sleeve is configured to apply a second force opening the closure mechanism in response to an extension of the spring.

2. The well closure system of claim 1, wherein the pressure source comprises a second portion of the passageway that is further from the surface of the wellbore than the closure mechanism, wherein the control line is configured to communicate the pressure from the second portion of the passageway that is further from the surface of the wellbore than the closure mechanism.

3. The well closure system of claim 1, further comprising a pump, wherein the pressure source comprises a discharge port of the pump, wherein the control line is configured to communicate the pressure from the discharge port of the pump.

4. The well closure system of claim 3, wherein the control line is configured to communicate additional pressure from the discharge port preventing the return mechanism from retracting the sleeve.

5. The well closure system of claim 3, wherein the pump is an electric submersible pump.

6. The well closure system of claim 3, wherein the pump is an auxiliary pump included in an electric submersible pump.

7. A well closure system configured for being disposed in a wellbore through a fluid-producing formation, the well closure system comprising:

an auxiliary pump included in an electric submersible pump and configured to use a dedicated hydraulic fluid source;

a subsurface safety valve comprising:

a closure mechanism configured to be positioned in a passageway defined by a tubing string, wherein the closure mechanism is configured to prevent a flow of fluid to a portion of the passageway that is closer to a surface of the wellbore than the closure mechanism, a sleeve adjacent to the closure mechanism, the sleeve configured to be positioned in the passageway defined by the tubing string; and a pressure-communicating device configured to communicate pressure from a discharge port of the auxiliary pump to a piston causing the piston to apply a force to the sleeve, wherein the sleeve is configured to open the closure mechanism in response to the force being applied to the sleeve.

8. The well closure system of claim 7, wherein the pressure-communicating device comprises a control line from the discharge port to the piston.

9. The well closure system of claim 7, wherein the auxiliary pump is further configured to use wellbore fluid from the wellbore as a hydraulic fluid source.

10. The well closure system of claim 7, wherein the pressure-communicating device comprises a control line from the discharge port to the piston.

* * * * *

UNITED STATES PATENT AND TRADEMARK OFFICE

CERTIFICATE OF CORRECTION

PATENT NO. : 9,157,299 B2
APPLICATION NO. : 13/703933
DATED : October 13, 2015
INVENTOR(S) : James Dan Vick, Jr. et al.

It is certified that error appears in the above-identified patent and that said Letters Patent is hereby corrected as shown below:

In the Specification:
In column 3, line 17, delete "salve." and insert -- valve. --, therefor.

Signed and Sealed this
Twenty-third Day of August, 2016

Michelle K. Lee

Michelle K. Lee
*Director of the United States Patent and Trademark Office*